United States Patent [19]

Fraioli

[11] 4,186,530

[45] Feb. 5, 1980

[54] TRIPLE WALL PANEL UNIT FOR AIR SUPPORTED STRUCTURE

[75] Inventor: Donato M. Fraioli, Mamaroneck, N.Y.

[73] Assignee: Air Tech Industries Inc., Clifton, N.Y.

[21] Appl. No.: 861,845

[22] Filed: Dec. 19, 1977

Related U.S. Application Data

[63] Continuation-in-part of Ser. No. 696,635, Jun. 16, 1976, Pat. No. 4,065,889.

[51] Int. Cl.[2] ..... E04B 1/34

[52] U.S. Cl. ..... 52/2

[58] Field of Search ..... 52/2

[56] References Cited

U.S. PATENT DOCUMENTS

| | | | |
|---|---|---|---|
| 2,748,401 | 6/1956 | Winstead | 52/2 |
| 2,922,344 | 1/1960 | Meissner | 52/2 |
| 3,030,640 | 4/1962 | Gosman | 52/2 |
| 3,161,553 | 12/1964 | Visser | 52/2 |
| 3,742,657 | 7/1973 | Price | 52/2 |
| 3,776,805 | 12/1973 | Hansen | 52/2 |
| 3,779,847 | 12/1973 | Turner | 52/2 |
| 3,877,084 | 4/1975 | Johnson | 52/2 |
| 3,936,984 | 2/1976 | Yando | 52/2 |

FOREIGN PATENT DOCUMENTS

| | | | |
|---|---|---|---|
| 2308715 | 8/1974 | Fed. Rep. of Germany | 52/2 |

*Primary Examiner*—James A. Leppink
*Assistant Examiner*—Henry E. Raduazo
*Attorney, Agent, or Firm*—Darby & Darby

[57] ABSTRACT

A panel unit for an air supported structure including an outer wall, a pair of first inner insulating panels attached to said outer wall adjacent one another, and a second insulating panel attached to a pair of said first insulating panels spanning and covering the junction of two said first insulating panels to provide insulation at the junction. Air relief vents are provided on both said first and second insulating panels to permit trapped air to be vented when the structure is collapsed.

7 Claims, 4 Drawing Figures

TRIPLE WALL PANEL UNIT FOR AIR SUPPORTED STRUCTURE

BACKGROUND OF THE INVENTION

This application is a continuation-in-part of my prior co-pending application Ser. No. 696,635 filed June 16, 1976 entitled "Double Wall Fabric Panel Unit", which is assigned to the same assignee now U.S. Pat. No. 4,065,889.

In my prior co-pending application Ser. No. 696,635, a double wall panel unit is disclosed for use with an air-supported structure. The air-supported structure of that application is formed by a plurality of panels which are attached together in a desired manner, for example, by heat-sealing, sewing, lacing or some other similar technique. A liner panel is provided on the interior of the structure's outer wall panel to provide insulation. The liner panel of the aforesaid application has strips along its side edges to permit heat sealing to the interior of the outer wall. The strips are discontinuous leaving openings so that air can escape from the space between the insulating panel and the outer wall when the structure is collapsed.

In structures of the type according to the aforesaid application, it is desired that additional insulation be provided in the junction areas between two adjacent insulatng panels for the purpose of conserving as much heat as possible within the structure.

Accordingly, the present invention relates to a novel air-supported structure and, more particularly, to a triple-wall panel unit for such a structure in which a first insulating panel is attached to the interior of the the outer wall. The attachment of the first-insulating panel is preferably by strips at the edges of such insulating panel with these strips being discontinuous to provide air vents. A second insulating panel is provided which is attached to the interior faces of two adjacent first insulating panels. Each second insulating panel spans the junction of two first insulating panels to provide insulation of the junction area. Each second insulating panel is also provided with a plurality of vents so that when a complete panel unit of the structure is collapsed, air can escape from the space between a first insulating panel and the outer wall to the space between the first and second insulating panels and then through the second insulating panels.

It is therefore an object of the present invention to provided a novel panel arrangement for an air supported structure.

An additional object is to provide a triple wall panel unit for an air supported structure.

A further object is to provide a triple wall panel unit having good insulating properties for the wall of an air supported structure.

Another object is to provide the outer wall of an air supported structure with first and second interior insulating panels, provision being made to permit air to escape from between the panels when the structure is collapsed.

Other objects and advantages of the present invention will become more apparent upon reference to the following specification and annexed drawings, in which.

Figure 1:
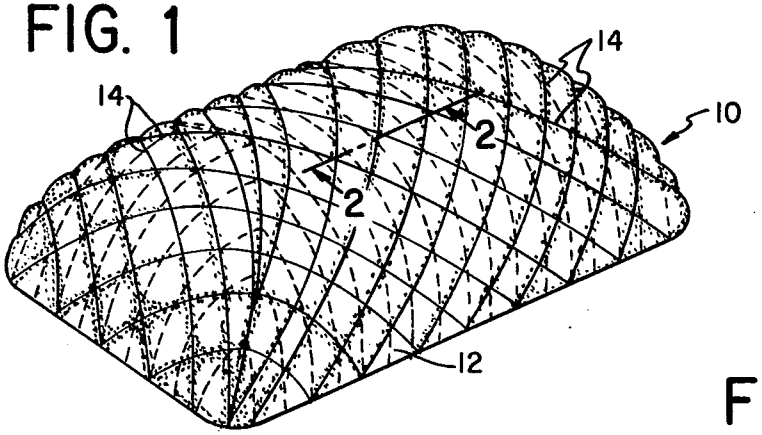
FIG. 1 is an overall perspective view of an air supported structure.

Referring to FIG. 1, an air supported structure 10 of generally rectangular shape is shown. As is known, such structures can have substantially any desired shape. The structure 10 is formed by a number of panels 12, the details of which are given below. The panels 12 are fastened together in a conventional manner, for example, by sewing, heat sealing, lacing, etc. The panels 12 forming the structure are overlayered by a cable harness formed by a plurality of cables 14. One suitable type of cable harness is disclosed in my prior U.S. Pat No. 3,885,360, granted May 27, 1977 and assigned to the assignee of the subject application. The ends of the cables 14 are anchored to the ground.

In erecting a structure of the type shown in FIG. 1, the panels 12 are connected together to form the desired shape structure either in the factory or in the field. The connected panels are placed on the ground and then overlayed with the preassembled cable harness. The building is then inflated with air to its predetermined shape with the cables restraining the structure.

Figure 4:
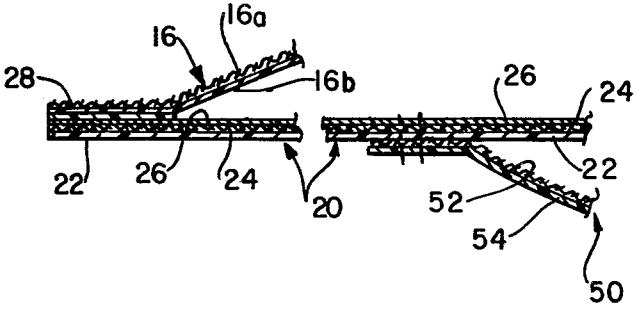
FIG. 4 is a view in cross-section showing the construction of the insulating panels.
Figure 2:
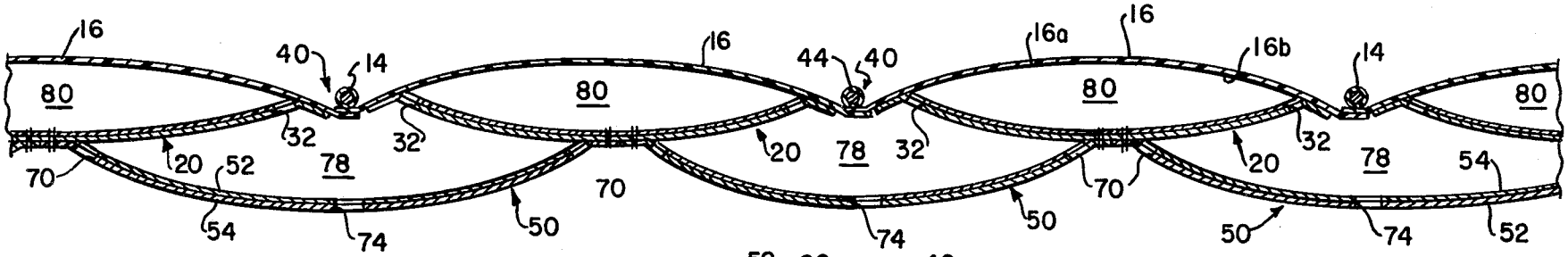
FIG. 2 is a top view taken in section along lines 2—2 of FIG. 1, showing several of the panel units forming the structure.
Figure 3:
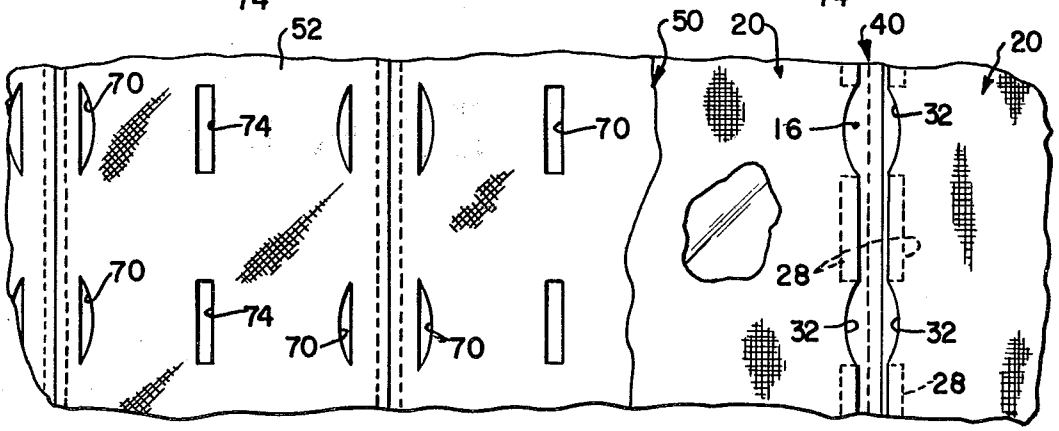
FIG. 3 is plan view of a portion of several panel units looking from the inside of the structure and shown broken away.

In accordnce with the invention, a novel structure is provided for the panels 12. Referring to FIGS. 2–4, each of the panels 12 is formed by an outer wall strip 16 which can be of fabric, rubberized fabric, fabric coated with plastic, or any suitable combination thereof.

Spanned across each outer wall strip 16, along the length thereof, is a first insulating panel 20, several preferred forms of which are described in the aforesaid co-pending application Ser. No. 696,635. One embodiment of the first insulating panel 20 in the aforesaid application, as shown in FIG. 4, is a layered structure including a backing 22 of plastic (e.g., a PVC type plastic) or other similar material, a layer 24 of insulating material, such a fiberglass, plastic foam, or other similar material, a reflecting layer 26, for example of aluminum foil or white fabric, and an edge strip 28 of plastic (e.g., a PVC type) along each edge of the inner panel. The outer wall 16 has an outer layer **16*a* of fabric, for example nylon, and a layer 16*b*** of a plastic material (e.g., a PVC type plastic) coated on its interior.

The strips 28 along the edges of each of the first liner panels 20 are discontinuous (see FIG. 3) to thereby form a number of vents 32. The first liner panels 20 are heat-sealed at the edge strips 28 to the inner plastic layer **16*b* of the outer wall 16. Vents (not shown) are also provided at the top and bottom of each liner panel 20. The purpose of the side vents 32 and the upper and lower vents is to permit air trapped between the inner surface of the outer wall 16 and the inner surface of the first liner panel 20** to escape as the building structure is collapsed, for example, for repair or storage.

As seen in FIG. 2, there is an area 40 between the juncture of two adjacent first liner panels 20 extending along the length of the panels. This area is not insulated by a first panel 20 since there is neither the insulating properties of panel 20 nor the air space.. To conserve as much energy as possible, that is, to reduce the ingress of cold through the wall of the structure of the egress heat from inside the structure, it is desired to insulate this area.

In accordance with the invention, a second insulating liner panel 50 is provided. Each second liner panel 50 spans the junction area 40 and portions of a pair of the first panels 20 and is attached along its edges to the pair of first panels 20 that it spans. As shown in FIGS. 2 and 4, each second insulating panel 50 is a two-layered structure, comprising a backing layer 52 and a layer of insulating material 54. As is also seen, a second insulating panel 52 is preferably attached along its edges at or adjacent the central portions of the two first insulating panels 20 that it spans. In FIGS. 2 and 4, the attachment is shown as being by sewing. If desired, the inner layer of the second panel 50 can be of plastic, or strips similar to the strips 28 can be provided along its edges so that a second panel 50 can be heat sealed to the back face of the respective pair of first panels 20.

As seen in FIG. 3, each second insulating panel 50 is also provided along its side edges with a plurality of vents 70 which are cut out sections of second panel 50. Where discontinuous strips such as 28 are used to attach the second panel to the pair of first panels, the spaces between the strips form the vents 70. Each panel 50 also preferably has along its central portion thereof a plurality of longitudinal vents 74.

The second panel vents 70 and 74 communicate with the space 78 between the outwardly facing surfaces of the second panels and the inwardly facing surfaces of the first panels 20. Vents 32 in the first panels 20 and the vents at the ends of these panels provide communication between the spaces 78 and 80, the latter being between the outwardly facing surface of the first panel and the inwardly facing surface of wall 16. Consequently in the collapsing of the structure, the air trapped in the spaces 78 escapes through the various side vents 32 and the upper and lower vents of the first insulating panels into the spaces 80. The air moved from spaces 78 to spaces 80 as well as the air originally in the spaces 80 escapes through the various side vents 70 and the central vents 74 which are properly sized and configured to handle the air flow. If desired, one or more of the sets of the side vents 70 or the central vents 74 can be eliminated.

The second insulating panels 50 can be narrower than shown, to span only the junction areas 40 and a smaller portion of the first panels. However, when made wider, they provide a double insulating effect in conjunction with the first panels 20.

The second insulating panels also can, if desired, be formed with a layer of reflecting material such as 26 of the first panel.

What is claimed is:

1. A collapsible unit for an air supported structure comprising:

an outer wall, a pair of elongated first panel members attached along their edges adjacent one another to one surface of said outer wall to define a first space between each of said first panel members and said outer wall, a second elongated panel member attached to the respective surfaces of said pair of first panel members facing outwardly from said one surface of said outer wall and spanning the two adjacent edges of said pair of first panel members to define a second space between said first and said panel members, first means on each of said members of said pair of first panel members along a substantial portion of the length thereof adjacent a respective edge of each of said panel members of said pair of first panel members for venting as the panel unit is collapsed at least a part of the air contained in each of said first spaces to said second space, and second means on said second panel member along a substantial portion of the length thereof which lie along a path generally confronting said first means for venting as the panel unit is collapsed the air originally contained in said second space and the air which is transferred from said first spaces to said second space as the panel unit is collapsed.

2. A panel unit as in claim 1 wherein said first panel members are attached to said one surface of said outer wall by spaced means along the respective edges thereof, the spaces between said spaced means comprising said first means for venting the contained air.

3. A panel unit as in claim 1 wherein said second panel member is attached to said pair of first panel members by spaced means along the edges thereof, the spaces between said spaced means comprising said second means for venting the contained air.

4. A panel unit as in claim 1 wherein said second means on said second panel member for venting the contained air also comprises vents along the sides of said second panel member.

5. A panel unit as in claim 3 wherein said second means on said second panel member for venting the contained air also comprises vents along the sides of said second panel member.

6. A panel unit as in claim 1 further comprising reflective means on each of said first panel members facing said one surface of said outer wall.

7. A panel unit as in claim 1 further comprising reflective means on a said second panel member facing said one surface of said outer wall.

* * * * *